US010016762B2

(12) United States Patent
Chen et al.

(10) Patent No.: US 10,016,762 B2
(45) Date of Patent: Jul. 10, 2018

(54) VERTICAL BOWL MILL FOR PRODUCING COARSE GROUND PARTICLES

(71) Applicant: ARVOS Inc., Wellsville, NY (US)

(72) Inventors: Michael M. Chen, Naperville, IL (US); Jianrong Chen, Naperville, IL (US); Timothy P. Johns, Naperville, IL (US)

(73) Assignee: Arvos Raymond Bartlett Snow LLC, Warrenville, IL (US)

( * ) Notice: Subject to any disclaimer, the term of this patent is extended or adjusted under 35 U.S.C. 154(b) by 276 days.

(21) Appl. No.: 14/741,077

(22) Filed: Jun. 16, 2015

(65) Prior Publication Data

US 2016/0367997 A1 Dec. 22, 2016

(51) Int. Cl.

| | |
|---|---|
| ***B02C 15/00*** | (2006.01) |
| ***B02C 23/08*** | (2006.01) |
| ***B02C 15/04*** | (2006.01) |

(52) U.S. Cl.

CPC ..... *B02C 15/003* (2013.01); *B02C 15/001* (2013.01); *B02C 15/04* (2013.01); *B02C 23/08* (2013.01); *B02C 2015/002* (2013.01)

(58) Field of Classification Search

CPC ..... B02C 15/003; B02C 15/04; B02C 15/001; B02C 23/08; B02C 2015/002

USPC ..... 241/117, 119

See application file for complete search history.

(56) References Cited

U.S. PATENT DOCUMENTS 2,641,387 A * 6/1953 Christensen ..... B01F 15/00785 222/556
3,556,419 A * 1/1971 Frangquist ..... B02C 15/04 241/119
3,951,347 A * 4/1976 Tiggesbaumker .... B02C 15/007 241/119
4,582,260 A * 4/1986 Folsberg ..... B02C 15/007 241/119
4,597,537 A * 7/1986 Misaka ..... B02C 15/04 241/119

(Continued)

FOREIGN PATENT DOCUMENTS

| | | |
|---|---|---|
| CN | 103567019 A | 2/2014 |
| EP | 2764922 A1 | 8/2014 |
| GB | 2187657 A | 9/1987 |

OTHER PUBLICATIONS

European Search Report and Written Opinion issued in corresponding Luxembourg Patent Application No. 92816, dated May 4, 2016, pp. 1-12.

*Primary Examiner* — Faye Francis
(74) *Attorney, Agent, or Firm* — Murtha Cullina LLP

(57) ABSTRACT

A bowl mill for producing coarse ground particles has a substantially closed body, a bowl assembly, a plurality of grinding rolls, and a coarse particle transport enabling area. The substantially closed body has an interior area. The bowl assembly includes a rotatable grinding table mounted for rotation in a direction of rotation in the interior area. The grinding table has a grinding surface thereon. The plurality of grinding rolls are positioned proximate the grinding surface. The grinding rolls and the grinding surface define a grinding area therebetween. The coarse particle transport enabling area is located radially outward from the grinding area. The coarse particle transport enabling area is configured to allow the coarse particles to freely exit the grinding area and to mitigate the coarse particles from being circulated back into the grinding area.

9 Claims, 6 Drawing Sheets

(56) References Cited

U.S. PATENT DOCUMENTS

| | | | | | |
|---|---|---|---|---|---|
| 4,689,141 | A * | 8/1987 | Folsberg | B07B 11/04 | 209/148 |
| 4,694,994 | A * | 9/1987 | Henne | B02C 23/32 | 241/119 |
| 4,869,434 | A * | 9/1989 | Folsberg | B02C 15/007 | 241/119 |
| 4,982,905 | A * | 1/1991 | Holsiepe | B02C 23/02 | 241/119 |
| 5,180,113 | A * | 1/1993 | Gehrke | B02C 23/32 | 209/139.1 |
| 5,330,110 | A * | 7/1994 | Williams | B02C 15/02 | 241/119 |
| 5,381,968 | A * | 1/1995 | Lohnherr | B02C 23/32 | 241/119 |
| 7,267,293 | B2 * | 9/2007 | Chen | B02C 15/001 | 241/117 |
| 8,052,077 | B2 * | 11/2011 | Thiel | B02C 15/00 | 241/119 |
| 8,925,844 | B2 * | 1/2015 | Keyssner | B02C 15/007 | 241/117 |
| 2006/0255195 | A1 | 11/2006 | Chen et al. | | |

* cited by examiner

VERTICAL BOWL MILL FOR PRODUCING COARSE GROUND PARTICLES

TECHNICAL FIELD

The present invention is directed to a vertical bowl mill for producing coarse ground particles, and more specifically to such a vertical bowl mill having a coarse particle transport area located radially outward from the grinding area, the coarse particle transport area being configured to allow the coarse particles to freely exit the grinding area and to mitigate and/or prevent the coarse particles from being circulated back into the grinding area and to reduce the production of fine particles.

BACKGROUND

Various types of grinding mills are typically employed to grind solid materials such as minerals, limestone, gypsum, phosphate rock, salt, coke, biomass and coal into small particles for use in a wide range of processes such as for combustion in furnaces and for chemical reactions in reactor systems. There are many types and configurations of grinding mills including ball mills, roller mills and bowl type vertical grinding mills. The ball mills typically include a horizontal rotating cylinder containing a charge of tumbling or cascading balls. The roller mills are sometimes referred to as pendulum mills which include a support shaft rotationally supported by a bearing housing. One end of the shaft is coupled to a drive unit for rotating the shaft. An opposing end of the shaft has a hub mounted thereto. A plurality of arms extend from the hub. Each of the arms pivotally supports a roller journal which has a roller rotatingly coupled to an end thereof. The rollers rollingly engage the grinding ring. During operation of the roller mill, centrifugal forces drive the crushing members against the grinding ring. The crushing members pulverize the solid material against the grinding ring as a result of contact with the grinding ring.

As shown in FIG. 1, bowl type vertical grinding mills 100 typically include a body portion 110 in which a bowl assembly 112 is mounted for rotation. The bowl assembly 112 includes a grinding table 112T having a wear insert (e.g., a wear resistant liner) 112W secured therein. The wear insert 112W defines a grinding surface 116 thereon. Typically, these grinding mills 100 include three grinding rollers 118 each mounted on a suitably supported journal 120. The grinding rollers 118 interact with the grinding table 112T to effect the grinding of material interposed therebetween. After being pulverized, the particles of material are thrown outwardly by centrifugal force whereby the particles of material are fed into a stream of air that is entering the mill 100. The stream of air with the particles of material entrained therein flows into a classifier in which coarse particles of material are rejected from the air stream. These rejected coarse material particles are then returned to the grinding table 112T for further pulverization, while the fine particles of material are carried through the bowl mill 100 in the air stream, and exit along with the air.

As best shown in FIG. 2, the wear insert 112W is secured to the grinding table 112T with a clamp ring 115 located at a radially outward most portion of the grinding table 112T. A dam ring 114 extends axially upward from the clamp ring 115. The dam ring 114 is configured to prevent particles from being prematurely thrown out of the pulverizing range of the rollers 118 by centrifugal force created by the rotation of the bowl assembly 112. Thus, the dam ring 114 has been considered an essential component to ensure proper operation of all bowl mills.

As shown in FIG. 1, a classifier 122 is positioned on an upper end of the body portion 110 of the bowl mill 100 within and occupying an interior area defined by a cone 124. The classifier 122 may be a static classifier, a dynamic classifier or a hybrid classifier including those described in U.S. Pat. No. 7,267,293, which issued Sep. 11, 2007. The classifier 122 operates to effect a further sorting of the particles of material that remain in the air stream. Namely, those particles of pulverized material which are of the desired particle size pass through the classifier 122 and, along with the air, are discharged from the bowl mill 100 through outlets (not shown). Those particles of material which in size are larger than desired, i.e., coarse particles, are returned to the bowl assembly 112, via the cone 124, whereupon they undergo additional pulverization.

The prior art bowl mills 100 are generally suitable for producing fine particles, but cannot produce coarse particles coarser than 40-50 percent passing 200 mesh. As used herein, the percent of material passing a sieve screen refers to the amount of material smaller than that particular sieve opening. However, there is a need to produce a larger amount coarser particles in certain applications. For example, certain types of sorbents (e.g., limestone for a circulating fluidized bed (CFB) boiler) and biomass fuels are required to be ground or pulverized to coarser particle sizes such as for example, particles having a fineness of 99 percent passing a 1 or 2 mm sieve opening. In addition, such sorbents and biomass fuels have limitations on the amount of fine particles that are included in the pulverized product. For example, fine particles can be limited to 25 percent passing 200 or 325 mesh. For the case of sorbent applications, the fine particles can be blown out of the CFB boiler before completely reacting with sulfur. For biomass applications, the fine material less than 200 mesh (75 μm) is an explosive dust and should be limited. Thus, there is a rather narrow range of acceptable particle sizes for certain sorbents and biomass fuels. The prior art bowl mills 100 are generally not capable of producing a large percentage of coarse particles and tend to overgrind the particles. Such overgrinding causes an undesired increase in power consumption, a decrease in throughput of the bowl mill 100, and thus increasing the amount of sorbent usage for the case of sorbent application.

Based on the foregoing, there is a need for an improved bowl mill that is configured to produce such coarse particles in the acceptable range while limiting the amount of fine particles.

SUMMARY

In one aspect, the present invention resides in a bowl mill for producing coarse ground particles. The bowl mill includes a substantially closed body, a bowl assembly, a plurality of grinding rolls, and a coarse particle transport enabling area. The substantially closed body has an interior area. The bowl assembly includes a rotatable grinding table mounted for rotation in a direction of rotation in the interior area. The grinding table has a grinding surface thereon. The plurality of grinding rolls are positioned proximate the grinding surface. The grinding rolls and the grinding surface define a grinding area therebetween. The coarse particle transport enabling area is located radially outward from the grinding area. The coarse particle transport enabling area is configured to allow the coarse particles to freely exit the grinding area and to mitigate and/or prevent the coarse particles from being circulated back into the grinding area.

In one embodiment, the coarse particle transport area is defined by an upwardly facing exposed surface on the bowl assembly. In one embodiment, the upwardly facing exposed surface is on the grinding table.

In one embodiment, the bowl mill further includes a wear insert secured to the grinding table by a clamp ring that circumferentially surrounds the wear insert. The coarse particle transport enabling area is defined by an upwardly facing exposed surface on the clamp ring.

In one embodiment, the bowl mill further includes a hollow cone shaped structure secured to an upper portion of the body. The hollow cone shaped structure defines a free space therein. In one embodiment, the hollow cone shaped structure tapers radially inward in a direction of flow therethrough. In one embodiment, the hollow cone shaped structure tapers radially outward in a direction of flow therethrough.

In one embodiment, the bowl mill further includes a mill plow secured to the body. The mill plow has a leading edge, a trailing edge, and an angle of incline. The mill plow is positioned on a downstream side of one of the plurality of grinding rolls. The leading edge of the mill plow faces into the direction of rotation of the rotatable grinding table. The mill plow is configured to loosen material that is caked on the grinding surface.

In another aspect, the present invention resides in a bowl mill for producing coarse ground particles. The bowl mill includes a substantially closed body, a bowl assembly, a plurality of grinding rolls, and a hollow cone shaped structure. The substantially closed body has an interior area. The bowl assembly includes a rotatable grinding table mounted for rotation in a direction of rotation in the interior area. The grinding table has a grinding surface thereon. The plurality of grinding rolls is positioned proximate the grinding surface. The grinding rolls and the grinding surface define a grinding area therebetween.

In one embodiment, the hollow cone shaped structure tapers radially inward in a direction of flow therethrough. In one embodiment, the hollow cone shaped structure tapers radially outward in a direction of flow therethrough.

In another aspect, the present invention resides in a method for controlling particle size in a bowl mill. The method includes providing a bowl mill that includes a substantially closed body, a bowl assembly, and a plurality of grinding rolls. The substantially closed body has an interior area. The bowl assembly includes a rotatable grinding table mounted for rotation in a direction of rotation in the interior area. The grinding table has a grinding surface thereon. The plurality of grinding rolls is positioned proximate the grinding surface. The grinding rolls and grinding surface define a grinding area therebetween. The method further includes transporting coarse particles from the grinding area in a coarse particle transport enabling area. The coarse particle transport enabling area is configured to allow the coarse particles to freely exit the grinding area and to mitigate and/or prevent the coarse particles from being circulated back into the grinding area.

In one embodiment, the method further includes controlling fineness of the particles by adjusting air flow through the interior area.

In one embodiment, the method further includes controlling fineness of the particles by adjusting a speed of the grinding table.

In one embodiment, the method further includes controlling particle size by adjusting a pressure applied to the plurality of grinding rolls.

DETAILED DESCRIPTION

Figure 3:
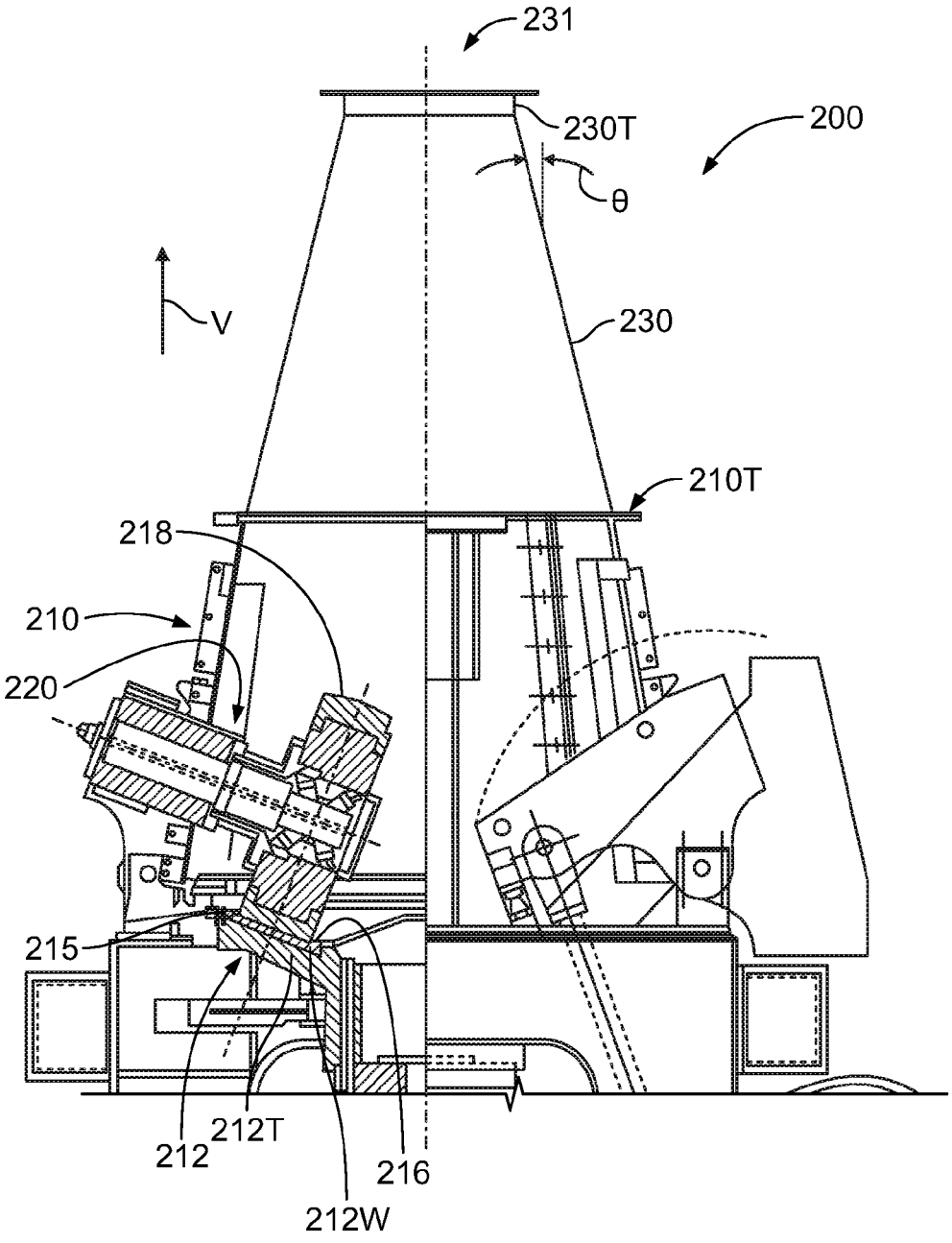
FIG. 3 is a partial cross sectional and front view of the bowl mill of the present invention.
Figure 4:
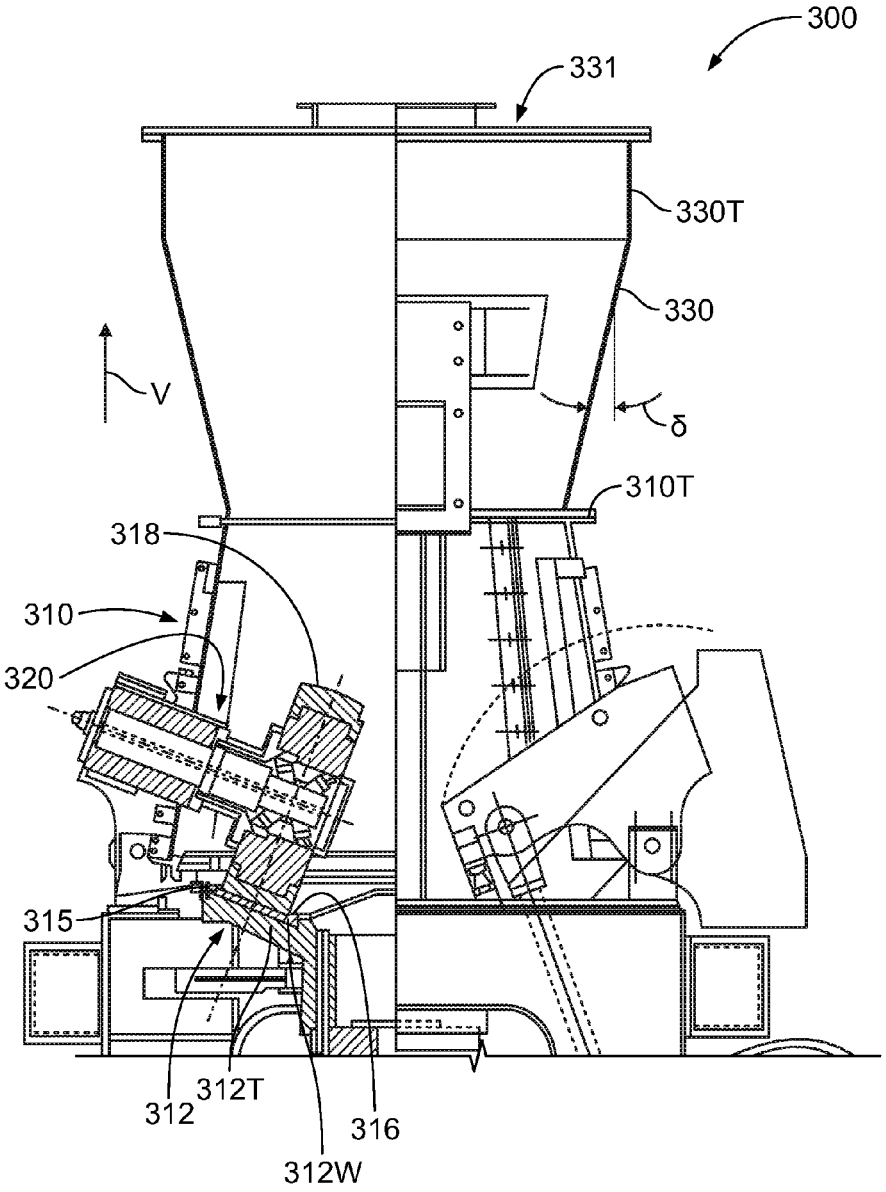
FIG. 4 is a partial cross sectional and front view of another embodiment of the bowl mill of the present invention.
Figure 5:
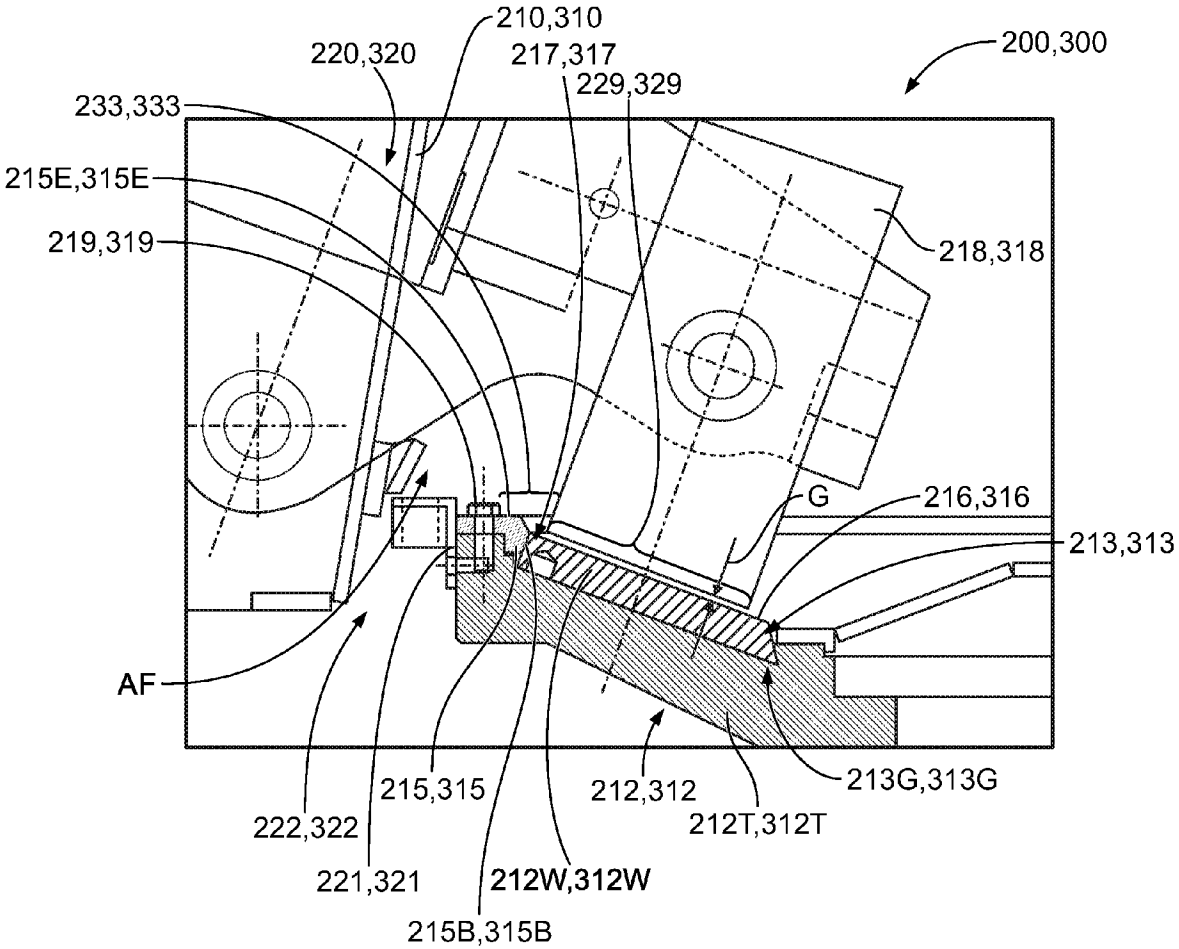
FIG. 5 is an enlarged view of a portion of a bowl assembly of the bowl mill of FIGS. 3 and 4.
Figure 7:
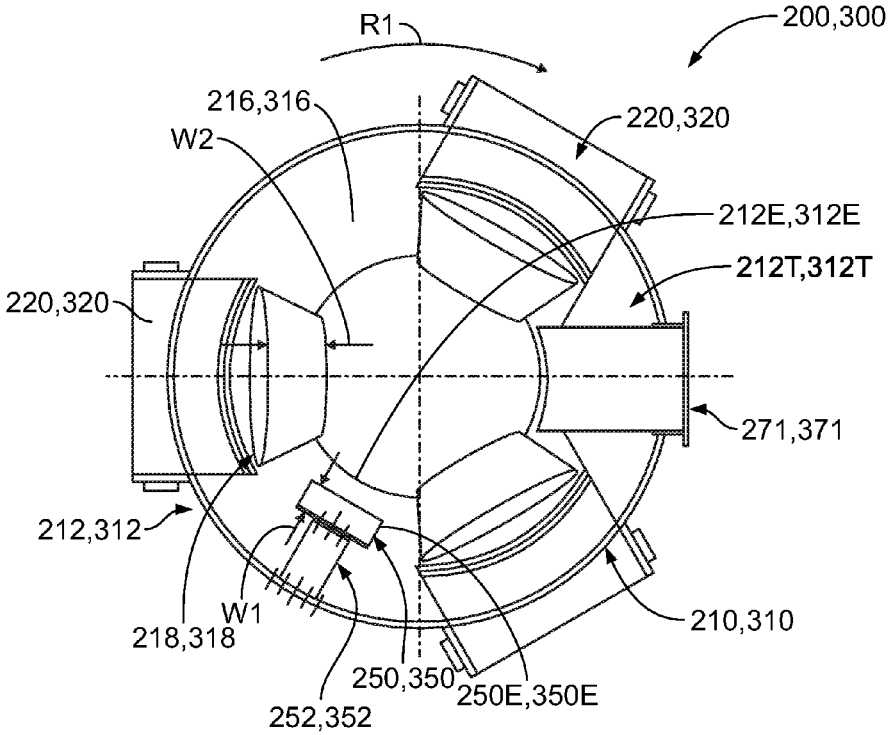
FIG. 7 is a top cut away view of the bowl mill of the present invention showing the mill plow of FIGS. 6A and 6B mounted thereto.

As shown in FIG. 3 a vertical (i.e., as indicated by the arrow V) pulverizing bowl mill for producing coarse particles is generally designated by reference numeral 200. The bowl mill 200 is configured to grind material and produce coarse particles having particle sizes defined by a fineness of 99 percent passing a 1 or 2 mm sieve opening and wherein fine particles are limited to 25 percent passing 200 or 325 mesh. The bowl mill 200 includes a substantially closed body 210. A bowl assembly 212 is mounted on a shaft (not shown), which in turn is operatively connected to a suitable drive mechanism (not shown) configured to rotatably drive the bowl assembly 212. A plurality of grinding rolls 218, for example three grinding rolls as shown in FIG. 7, are each suitably supported within an interior of the body 210 by an associated journal assembly 220 so as to be equidistantly spaced one from another around the circumference of the body 210. In the interest of maintaining clarity of illustration in the drawing, only one such grinding roll 218 and journal assembly 220 have been shown in FIG. 3. Each of the grinding rolls 218 are positioned proximate to a grinding surface 216, 316 (as shown in FIG. 4), for example, spaced apart from the grinding surface 216, 316 by a gap G, as shown in FIG. 5. The gap G defines a minimum bed depth for a grinding area 229, 329 as shown in FIG. 5 in which the material to be pulverized is ground into the coarse particles. The magnitude of the gap G is selected depending on the physical properties of the material to be pulverized and can be 0.25 inches, 0.5 inches 0.75 inches or any other suitable magnitude. A feed chute 271 extends through the body 210 to provide a conduit for supplying material to be ground to the grinding surface 216, as shown in FIG. 7.

As shown in FIG. 3, a hollow cone 230 (e.g., a hollow conical shaped structure, vessel or conduit) is mounted to a top portion 210T (e.g., upper or uppermost in the direction of the arrow V) of the body 210. The cone 230 defines a free space therein that is absent any structures such as the prior art classifiers. The cone 230 provides a conduit or path for transport of the pulverized coarse particles to flow through as the coarse particles exit the bowl mill 200. The cone 230 defines an angle θ relative to the vertical direction V such that the cone 230 tapers radially inward in the direction of the air flow as shown by the arrow V (e.g., an inverted cone).

The angle θ is predetermined to establish a once through grinding operation with no returns of coarse ground particles to the bowl assembly 212. After being pulverized, the coarse particles of material are thrown outwardly by centrifugal force towards the body 210 whereby the particles of material are fed into a stream of air that enters the mill 200 via suitable ducting (not shown). The stream of air with the coarse particles of material entrained therein flows into the cone 230 where the coarse particles are accelerated through the bowl mill 200 in the air stream, and exit along with the air. While the angle θ is described as being predetermined to establish a once through grinding operation with no returns of coarse ground particles to the bowl assembly 212, the present invention is not limited in this regard as the angle θ may be of other magnitudes to allow no more than 10 percent of the coarse particles to return the bowl assembly 212. The inventors have discovered that the bowl mill 200 having the cone 230 mounted to the top portion 210T of the body 210 has particular utility in producing coarse particles having high density such as limestone.

In one embodiment, the angle θ is from 0 to 20 degrees.

In one embodiment, the cone 230 has a cylindrical transition portion 230T mounted proximate an outlet 231 of the cone 230.

As shown in FIG. 4 a vertical (i.e., as indicated by the arrow V) pulverizing bowl mill for producing coarse particles is generally designated by reference numeral 300. The bowl mill 300 is configured similar to the bowl mill 200. Therefore, similar elements are assigned similar reference numbers wherein the leading digit "2" is replaced by the number "3". The bowl mill 300 is configured to grind material and produce coarse particles having particle sizes defined by a fineness of 99 percent passing a 1 or 2 mm mesh and wherein fine particles are limited to 25 percent passing 200 or 325 mesh. The bowl mill 300 includes a substantially closed body 310. A bowl assembly 312 is mounted on a shaft (not shown), which in turn is operatively connected to a suitable drive mechanism (not shown) configured to rotatably drive the bowl assembly 312. A plurality of grinding rolls 318, for example three grinding rolls as shown in FIG. 7, are each suitably supported within an interior of the body 310 by an associated journal assembly 320 so as to be equidistantly spaced one from another around the circumference of the body 310. In the interest of maintaining clarity of illustration in the drawing, only one such grinding roll 318 and journal assembly 320 have been shown in FIG. 4. A feed chute 371 extends through the body 310 to provide a conduit for supplying material to be ground to the grinding surface 316, as shown in FIG. 7.

As shown in FIG. 4, a hollow cone 330 is mounted to a top portion 310T of the body 310. The cone 330 defines a free space therein that is absent any structures such as the prior art classifiers. The cone 330 provides a conduit or path for transport of the pulverized coarse particles to flow through as the coarse particles exit the bowl mill 300. The cone 330 defines an angle δ relative to the vertical direction V such that the cone 330 tapers radially outward in the direction of the air flow as shown by the arrow V. The angle δ is predetermined to provide more volume for the low density material like biomass and also establish a grinding operation that coarse ground particles such as over 1 mm fall out and drop to the bowl assembly 312. After being pulverized, the coarse particles of material are thrown outwardly by centrifugal force towards the body 310 whereby the particles of material are fed into a stream of air that enters the mill 300 via suitable ducting (not shown). The stream of air with the coarse particles of material entrained therein flows into the cone 330 where the coarse particles are flow through the bowl mill 300 in the air stream, and exit along with the air. While the angle δ is described as being predetermined to establish a grinding operation that coarse ground particles such as over 1 mm fall out and drop to the bowl assembly 312, the present invention is not limited in this regard as the angle δ may be of other magnitudes to allow particles bigger than such as 1 mm to drop out. The inventors have discovered that the bowl mill 300 having the cone 330 mounted to the top portion 310T of the body 310 has particular utility in producing coarse particles having relative low densities compared to limestone, such as for example, biomass fuels.

In one embodiment, the angle δ is from 0 to 15 degrees.

In one embodiment, the cone 330 has a cylindrical transition portion 330T mounted proximate an outlet 331 of the cone 330.

Referring now to FIG. 5, a portion of either of the bowl mills 200 or 300 is shown in an enlarged view for clarity. The bowl assemblies 212 and 312 each include a grinding table 212T, 312T, respectively. Each of the grinding tables 212T and 312T have a wear insert 212W, 312W, respectively, secured therein. Each of the wear inserts 212W and 312W define the grinding surface 216, 316, respectively, thereon. Each of the wear inserts 212W and 312W is secured to the respective grinding table 212T, 312T with a clamp ring 215, 315, respectively, that circumferentially surrounds the respective wear insert 212W, 312W and is located at a radially outward most portion of the grinding table 212T, 312T. Each of the wear inserts 212W and 312W have a wedge portion 213, 313, respectively, formed on one end thereof. Each of the wedge portions 213, 313 is pressed into a respective groove 213G, 313G formed in the respective grinding table 212T, 312T. An opposing end 217, 317 of the respective wear insert 212W, 312W abuts a respective abutment surface 215B, 315B of the clamp ring 215, 315, respectively, to force the wear insert 212W, 312W into the respective groove 213G, 313G. Each of the clamp rings 215, 315 is secured to the respective grinding table 212T, 312T by suitable fasteners, 219, 319, respectively.

Figure 1:
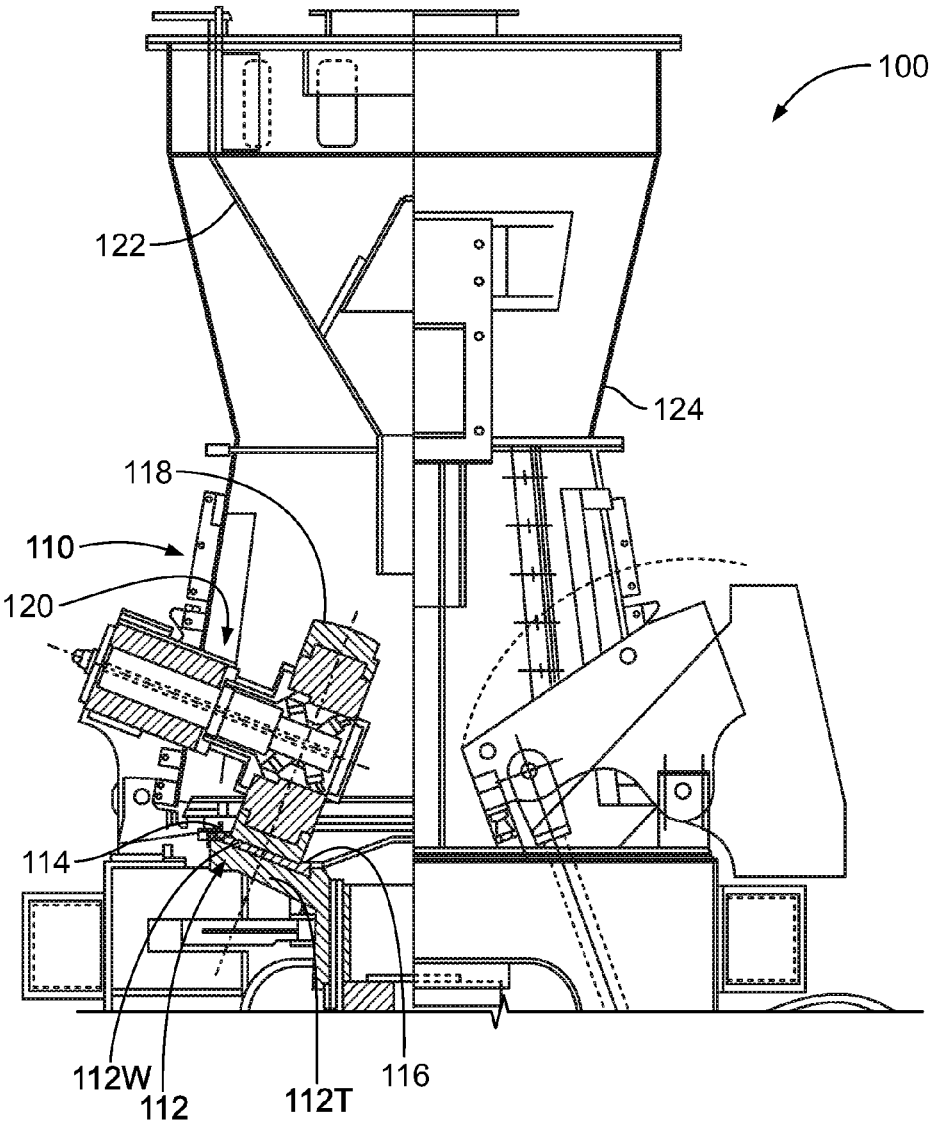
FIG. 1 PRIOR ART
FIG. 1 is a partial cross sectional and front view of a prior art bowl mill.
Figure 2:
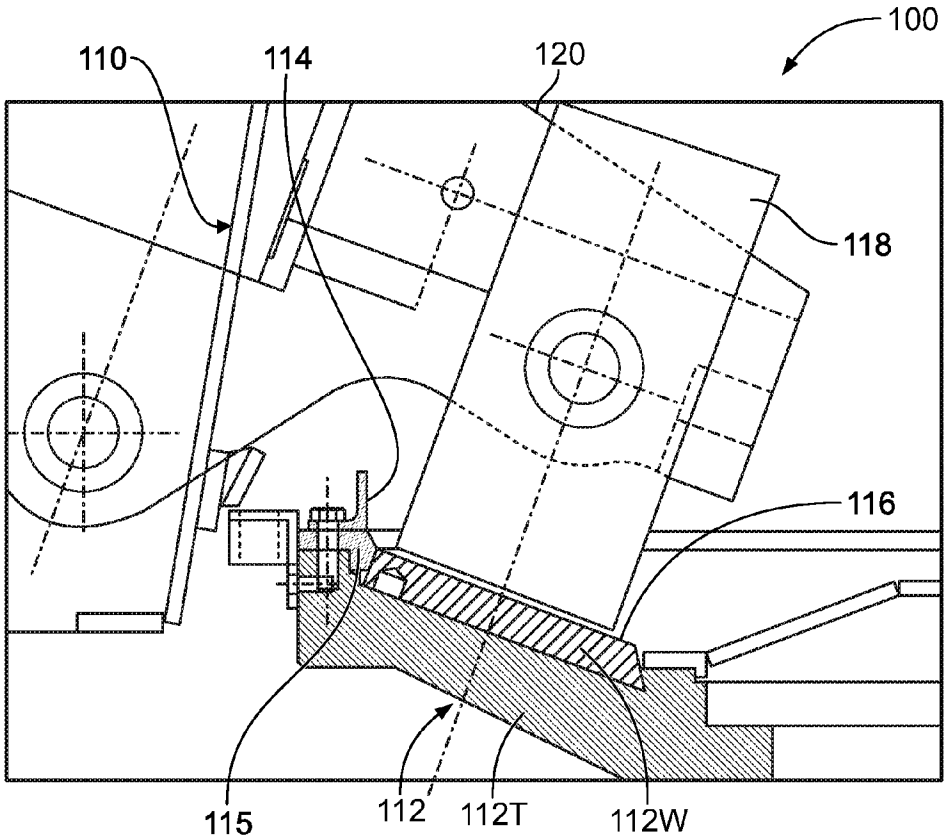
FIG. 2 PRIOR ART
FIG. 2 is an enlarged view of a portion of a bowl assembly of the prior art bowl mill of FIG. 1.

The grinding table 212T, 312T defines a coarse particle transport enabling area 233, 333 that enables the coarse particles exit the grinding areas 229 and 329 unimpeded. The coarse particle transport enabling area 233, 333 is located radially outward from the grinding area 229, 329. In one embodiment, the coarse particle transport enabling area 233, 333 is defined by an upwardly facing (i.e., in the direction of the arrow V) exposed surface 215E, 315E on the bowl assembly 212, 312, for example, formed on the respective clamp ring 215, 315. The exposed surfaces 215E and 315E are configured to allow the coarse particles to freely exit the grinding area 229, 329 and to mitigate and/or prevent the coarse particles from being circulated back into the grinding area 229, 329 by an impeding structure, such as the prior art dam ring 114, as shown in FIG. 2. Thus, the coarse particles exit the grinding areas 229 and 329 unimpeded.

While the coarse particle transport enabling area 233, 333, is shown and described in one embodiment as being defined by the upwardly facing exposed surface 215E, 315E formed on the respective clamp ring 215, 315, the present invention is not limited in this regard as other configurations of the particle transport enabling area may be employed including but not limited to a grinding table having an upwardly facing exposed surface configured to allow the coarse particles to freely exit the grinding area 229, 329 without being circulated back into the grinding area 229, 329; a castellated or segmented dam ring secured to the clamp ring and having circumferential openings configured to allow the coarse particles to freely exit the grinding area 229, 329 without being circulated back into the grinding area 229, 329 and/or a location of and edge of the grinding rolls 218, 318 proximate a radially outermost portion of the grinding table 212T, 312T.

In one embodiment, the grinding table 212T and/or 312T has an air flow vane wheel 221, 321 mounted to a radially outward facing circumferential surface thereof for establishing air flow rates and velocities, as indicated by the arrow AF in an annular area 222, 322 between the respective grinding table 212T, 312T and the body 210, 310, respectively. The air flow vane wheel 221, 321 is positioned sufficiently radially outward from the respective grinding table 212T, 312T so as not to impede the coarse particles from exiting the grinding areas 229 and 329 and not to interfere with the coarse particle transport enabling area 233, 333.

Figure 6A:
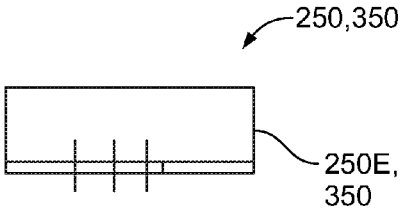
FIG. 6A is a top view of a mill plow for the bowl mill of the present invention.
Figure 6B:
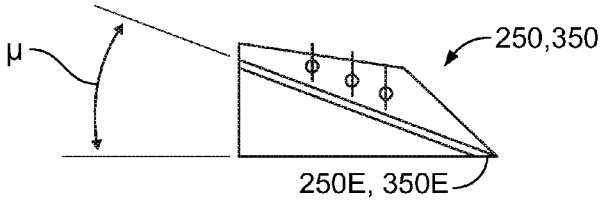
FIG. 6B is a side view of the mill plow of FIG. 6A.

As shown in FIGS. 6A, 6B and 7, in one embodiment, the bowl mill 200 and/or 300 includes at least one mill plow 250, 350 secured to the body 210, 310 by a bracket 252, 352. The mill plow 250, 350 loosens up any material that is caked on the grinding surface 216, 316. Once the caked material has been loosened by the mill plow 250, 350, the air stream will remove the loosened material that is sufficiently ground. The loosened material that has not been sufficiently ground will remain on the grinding surface 216, 316. Due to the loosening, the remaining material will have a new angle of contact with the grinding rolls 218, 318, providing for grinding to produce the coarse particles.

As shown in FIG. 6B, the mill plow 250, 350 has a wedge shape defined by an angle of incline μ. In one embodiment, the angle of incline μ is 10 to 30 degrees. The mill plow 250, 350 has a first width W1 approximately half of a second width W2 of each grinding roll 218, 318. The mill plow 250, 350 is located in between two grinding rolls 218, 318, as shown best in FIG. 7. When multiple mill plows 250, 350 are utilized, each mill plow 250, 350 is located between a different pair of grinding rolls 218, 318. The mill plow 250, 350 is preferably replaceable and made of a wear resistant material, such as Nihard® (Nihard® is a registered trademark of Bales Mold Service, Inc., Illinois, United States), although any wear resistant material having the requisite qualities could be utilized as desired. While the mill plow 250, 350 is shown and described as having a wedge shape, the present invention is not limited in this regard as other configurations and shapes may be employed including but not limited to, a rod or a bar so long as the mill plow 250, 350 is still capable of performing its intended function in accordance with the present invention.

The mill plow 250, 350 is preferably located close to an edge 212E, 312E of the grinding table 212T, 312T, respectively and in the path of the grinding rolls 218, 318 with a leading edge 250E, 350E oriented opposite the direction of rotation (R1 in FIG. 7) of the bowl assembly 212, 312. The mill plow 250, 350 is located proximate to the grinding table 212T, 312T such that compacted material on the grinding table 212T, 312T is disturbed, i.e., plowed, by the mill plow 250, 350, respectively. Preferably, the mill plow 250, 350 is not in contact with the grinding table 212T, 312T or the grinding surface 216, 316 of the bowl assembly 212, 312.

The present invention further includes a method for controlling particle size in a bowl mill 200, 300. The method includes providing a bowl mill 200, 300 comprising a substantially closed body 210, 310 having an interior area. The bowl mill 200, 300 includes a bowl assembly 212, 312 that includes a rotatable grinding table 212T, 312T mounted for rotation in a direction of rotation in the interior area. The grinding table 212T, 312T defines a grinding surface 216, 316 thereon. A plurality of grinding rolls 218, 318 are positioned proximate the grinding surface 216, 316. The grinding rolls 218, 318 and the grinding surface 216, 316 defining a grinding area 229, 329 therebetween. The method includes controlling particle size by adjusting a pressure applied to the plurality of grinding rolls 218, 318. In one embodiment, the method includes controlling fineness of the particles by adjusting air flow through the interior area. In one embodiment, the fineness of the particles is controlled by adjusting a speed of the grinding table.

EXAMPLE

Applicant has conducted testing and experimentation to determine the effect on particle fineness, capacity and power as a result of employing the a coarse particle transport enabling area 233, 333 located radially outward from the grinding area 239, 329 in the bowl mill 200, 300. The results of the three of the tests (i.e., Tests A, B and C) are summarized in Table 1, below. Tests A and B were performed using a 100 psi grinding roll pressure and an air flow rate of 5000 cubic feet per minute and the material that was ground in the mill was limestone from the USA. Test C was performed using a 200 psi grinding roll pressure and an air flow rate of 4000 cubic feet per minute and the material that was ground in the mill was limestone from Mexico.

TABLE 1

| Test Run | Dam Ring 114 | Bed Depth (Element G on FIG. 5 (mm)) | Throughput (lb/hr) | Total Power (kW-hr/ton) | Percent passing 75 μm/Percent passing 45 μm | Percent passing 2 mm/ Percent passing 1 mm |
|---|---|---|---|---|---|---|
| Test A Prior art bowl mill 100 | 1.5" Tall | 21 | 2540 | 12.9 | 59.2/52.5 | 100/99.9 |
| Test B Bowl Mill 200 of the present invention | Removed | 3 | 5710 | 5.8 | 30.2/24.7 | 99.9/99.1 |
| Test C Bowl Mill 200 of the present invention | Removed | 21 | 5700 | 7.8 | 21.9/17.0 | 99.9/98.8 |

Test A was the baseline test and employed a prior art bowl mill 100 having a 1.5 inch high dam ring 114. For Test A, the prior art bowl mill 100 employed a bed depth G of 21 mm. For Test A, 59.2 percent of the particles were passing a 75 μm sieve (i.e., 200 mesh) and 52.5 percent of the particles were passing a 45 μm sieve (i.e., 325 mesh); and 100 percent of the particles were passing a 2 mm sieve and 99.9 percent of the particles were passing a 1 mm sieve. In Test A, the prior art bowl mill 100 demonstrated a throughput of 2540 lb/hr; and required 12.9 kW-hr/ton total power to operate.

For Test B, no dam ring was employed in the bowl mill 200. For Test B, the bowl mill 200 employed a bed depth G of 3 mm. For Test B, 30.2 percent of the particles were passing a 75 μm sieve (i.e., 200 mesh) and 24.7 percent of the particles were passing a 45 μm sieve (i.e., 325 mesh); and 99.9 percent of the particles were passing a 2 mm sieve and 99.1 percent of the particles were passing a 1 mm sieve. In Test B, the bowl mill 200 demonstrated a throughput of 5710 lb/hr; and required 5.8 kW-hr/ton total power to operate.

For Test C, no dam ring was employed in the bowl mill 200. For Test C, the bowl mill 200 employed a bed depth G of 21 mm. For Test C, 21.9 percent of the particles were passing a 75 μm sieve (i.e., 200 mesh) and 17.0 percent of the particles were passing a 45 μm sieve (i.e., 325 mesh); and 99.9 percent of the particles were passing a 2 mm sieve and 98.8 percent of the particles were passing a 1 mm sieve. In Test C, the bowl mill 200 demonstrated a throughput of 5700 lb/hr; and required 7.8 kW-hr/ton total power to operate.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A bowl mill for producing coarse ground particles, the bowl mill consisting of:

a vessel having an interior area and a vessel outlet;

a bowl assembly comprising a rotatable grinding table mounted for rotation in a direction of rotation in a lower portion of the interior area, the grinding table having a grinding surface thereon;

a plurality of grinding rolls positioned proximate the grinding surface, the grinding rolls and the grinding surface defining a grinding area therebetween; and a coarse particle transport enabling area located radially outward from the grinding area, the coarse particle transport enabling area being defined by an upwardly facing exposed surface on the bowl assembly to allow the coarse ground particles to freely exit the grinding area and to mitigate the coarse ground particles from being circulated back into the grinding area, unimpeded by any structure intended to return the coarse ground particles to the bowl assembly; and a hollow cone shaped structure located above the bowl assembly and in direct communication with the coarse particle transport enabling area, the hollow cone shaped structure defining an unimpeded free space therein that is absent any classifiers or other structures intended to impede particle flow, the hollow cone shaped structure tapering radially inward in a direction of flow therethrough between the bowl assembly and the vessel outlet, the radially inward taper being configured to accelerate the coarse ground particles through the hollow cone shaped structure to discharge the coarse ground particles from the vessel outlet.

2. The bowl mill of claim 1, wherein the upwardly facing exposed surface is on the grinding table.

3. The bowl mill of claim 1, further comprising a wear insert secured to the grinding table by a clamp ring circumferentially surrounding the wear insert; and the coarse particle transport enabling area being defined by an upwardly facing exposed surface on the clamp ring.

4. The bowl mill of claim 1, further comprising:

a mill plow secured to the body, the mill plow having a leading edge, a trailing edge, an angle of incline, the mill plow being positioned on a downstream side of one of the plurality of grinding rolls; and wherein the leading edge of said mill plow faces into the direction of rotation of the rotatable grinding table, and said mill plow being configured to loosen material that is caked on the grinding surface.

5. A method for controlling particle size in a bowl mill, the method consisting of:

providing a bowl mill consisting of:

a vessel having an interior area and a vessel outlet;

a bowl assembly comprising a rotatable grinding table mounted for rotation in a direction of rotation in a lower portion of the interior area, the grinding table having a grinding surface thereon;

a plurality of grinding rolls positioned proximate the grinding surface, the grinding rolls and the grinding surface defining a grinding area therebetween;

a coarse particle transport enabling area located radially outward from the grinding area, the coarse particle transport enabling area being defined by an upwardly facing exposed surface on the bowl assembly;

a hollow cone shaped structure located above the bowl assembly and in direct communication with the coarse particle transport enabling area, the hollow cone shaped structure defining an unimpeded free space therein that is absent any classifiers or other structures intended to impede particle flow, the hollow cone shaped structure tapering radially inward in a direction of flow therethrough between the bowl assembly and the vessel outlet, allowing the coarse ground particles to freely exit the grinding area and to mitigate the coarse ground particles from being circulated back into the grinding area, unimpeded by any structure intended to return the coarse ground particles to the bowl assembly;

accelerating the coarse ground particles through the hollow cone shaped structure; and discharging the coarse ground particles from the vessel outlet.

6. The method of claim 5, further comprising:

controlling fineness of the coarse ground particles by adjusting air flow through the interior area.

7. The method of claim 5, further comprising:

controlling fineness of the coarse ground particles by adjusting a speed of the grinding table.

8. The method of claim 5, further comprising:

controlling coarse ground particle size by adjusting a pressure applied to the plurality of grinding rolls.

9. The method of claim 5, further comprising limiting the amount and size of fine ground particles being discharged from the vessel outlet, by the mitigating of the coarse ground particles from being circulated back into the grinding area.

* * * * *